US005431019A

United States Patent [19]

Myers et al.

[11] Patent Number: 5,431,019

[45] Date of Patent: Jul. 11, 1995

[54] COMBUSTOR FOR GAS TURBINE ENGINE

[75] Inventors: Geoffrey D. Myers, Phoenix; Manuel M. Cardenas, Jr., Scottsdale; Robert K. Hoover, Phoenix, all of Ariz.

[73] Assignee: AlliedSignal Inc., Morris Township, N.J.

[21] Appl. No.: 52,416

[22] Filed: Apr. 22, 1993

[51] Int. Cl.[6] ..... F23R 3/14

[52] U.S. Cl. ..... 60/737; 60/748; 239/404; 239/472

[58] Field of Search ..... 60/737, 748, 740, 734, 60/743; 239/404, 405, 472

[56] References Cited

U.S. PATENT DOCUMENTS

| | | | |
|---|---|---|---|
| 391,865 | 10/1888 | Schutte | 239/472 |
| 3,703,259 | 11/1972 | Sturgess et al. | 60/748 |
| 3,811,278 | 5/1974 | Taylor et al. | 239/404 |
| 3,937,011 | 2/1976 | Caruel et al. | 60/737 |
| 3,946,552 | 3/1976 | Weinstein et al. | 239/404 |
| 3,972,182 | 8/1976 | Salvi | 60/748 |
| 4,044,553 | 8/1977 | Vaught . | |
| 4,155,220 | 5/1979 | Emory . | |
| 4,198,815 | 4/1980 | Bobo et al. | 60/737 |
| 4,271,675 | 6/1981 | Jones et al. . | |
| 4,483,138 | 11/1984 | Willis . | |
| 4,754,600 | 7/1988 | Barbier et al. | 60/737 |
| 4,991,398 | 2/1991 | Clark et al. . | |

FOREIGN PATENT DOCUMENTS 164037 12/1933 Switzerland .

OTHER PUBLICATIONS

Lefebvre, Arthur H. *Gas Turbine Combustion*. New York, N.Y.: McGraw-Hill, 1983. pp. 413–422.

*Primary Examiner*—Timothy S. Thorpe
*Attorney, Agent, or Firm*—James W. McFarland

[57] ABSTRACT

An air blast fuel nozzle includes a unitary structure which introduces not only axially swirling primary airflow into the primary zone of the combustor chamber, but also introduces radial inflow, coswirling, primary airflow into the premixing chamber immediately upstream of the primary zone of the combustor.

11 Claims, 1 Drawing Sheet

COMBUSTOR FOR GAS TURBINE ENGINE

The United States Government has certain rights in this invention in accord with contract number F33615-87-C-2839 with the United States Air Force.

CROSS-REFERENCE TO RELATED APPLICATION

Similar subject matter is disclosed in our copending U.S. patent application number 08/052 417, now allowed filed simultaneously herewith and having common assignee herewith.

TECHNICAL FIELD

This invention pertains to gas turbine engines and relates more particularly to improved primary air swirlers for combustors.

BACKGROUND OF THE INVENTION

Critical to the fuel efficiency and the emissions of gas turbine engine is the combustion process. Appropriate mixing of fuel and air, including atomization of the fuel is important for generation of complete fuel combustion for purposes of efficiency and emissions control. Air blast fuel nozzles generally utilize particularly directed blasts of airflow to impinge upon and atomize the fuel prior to ignition and combustion thereof. Often atomization of the fuel flow occurs in a premixing chamber prior to introduction into the major portion of the combustion chamber. Not only the extent of atomization, as determined by the average fuel droplet size, but also the spray angle of the atomized mixture is important for good combustion processes in the primary zone of the combustion chamber. In this respect, primary airflow is introduced into the primary combustion zone wherein combustion initiates.

While a large volume of primary air is desirable for a variety of thermodynamic and combustion reasons, the magnitude of the primary air must necessarily be limited in a manner maintaining appropriate residence time in the primary zone to obtain a continuous combustion process and avoid flameout therein. To increase residence time in the primary zone it is generally known that swirling of the primary airflow contributes to appropriate combustion. The known arrangements for inducing axial swirl in the primary airflow leads to cumbersome, heavy and expensive structures. Additionally, attempts to introduce both radial and axial primary airflows into the primary zone of the combustor chamber dramatically increases complexity of the overall structure.

SUMMARY OF THE INVENTION

It is an important object of the present invention to provide an improved primary air swirler for the combustor of the gas turbine engine which, in a unitary structure, provides both swirling axial flow and swirling radial flow of the primary air in the region immediately adjacent the fuel nozzle.

In summary the present invention contemplates a unitary structure surrounding the fuel nozzle and extending axially forwardly therefrom toward the combustion chamber, which defines an annular zone in surrounding relation to the fuel nozzle. A plurality of vanes across the annular zone define a first set of passages delivering axial flow downstream of the swirler, and a second set of passages delivering radial inflow to a premixing chamber immediately downstream of the fuel nozzle. The vanes are arranged such that the swirling axial flow through the first set of passages swirls in the same direction as the swirling radial airflow delivered through the second set of passages.

These and other objects and advantages of the present invention are specifically set forth in or will become apparent from the following detailed description of a preferred form of the invention, when read in conjunction with the accompanying drawing.

DETAILED DESCRIPTION OF THE PREFERRED EMBODIMENT

Figure 1:
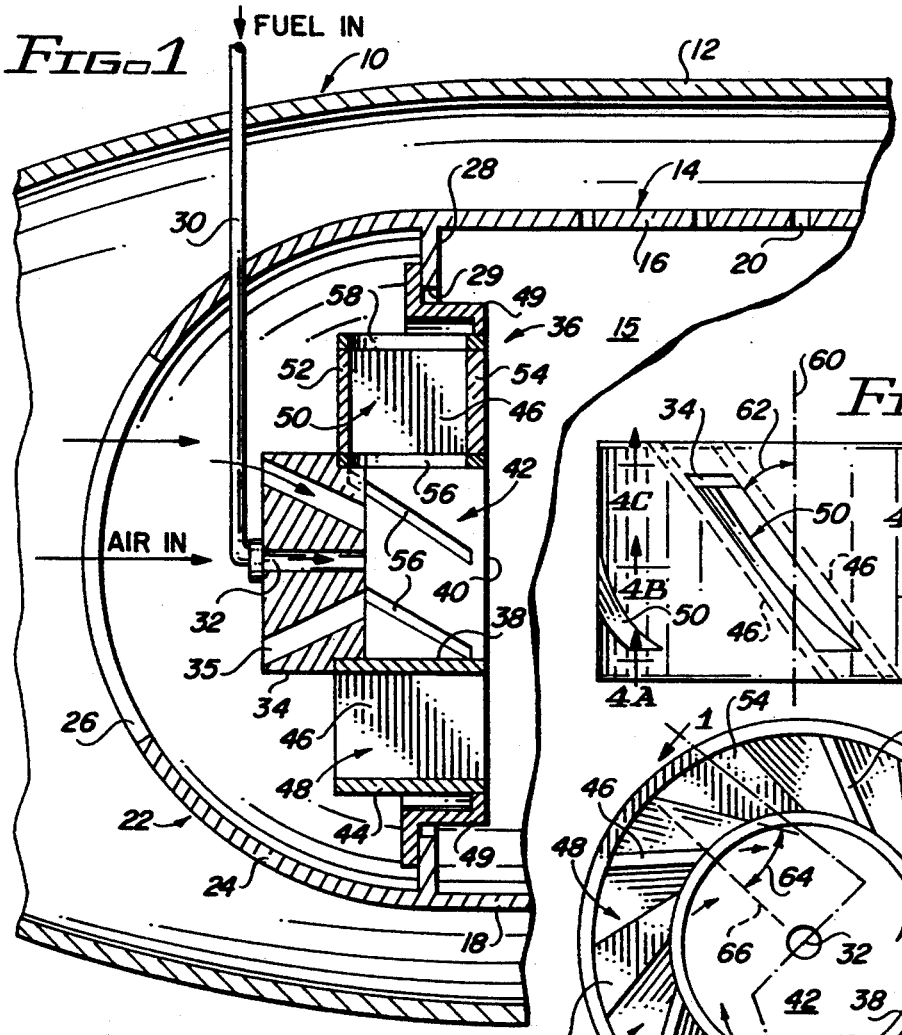
FIG. 1 is a partially schematic, partially plan cross-sectional view of a gas turbine combustor constructed in accordance with the principles of the present invention, with the cross-sectional cut-line through the air swirler being angularly offset as denoted by the line 1—1 of FIG. 2 to reveal details of construction.

Referring now more particularly to the drawing, a plenum or gas turbine engine combustor generally denoted by the numeral 10 includes a combustor case 12 and combustor liner 14. The combustor 10 illustrated is of annular configuration, and the liner 14 is comprised of an axially extending, annular outer liner 16, and a concentric, axially extending annular inner liner 18. Airflow perforations orifices 20 are conventionally included in the inner and outer liners 16, 18. At one end of the combustor is a dome 22 comprised of a hemispherical dome shroud 24 having a compressed air inlet 26, and a transverse end plate 28 having an opening 29 therein for passage of fuel and air into the combustion zone 15 located inside the combustor liner 14. A fuel supply 30 introduces fuel flow through a nozzle in the form of a central axial passage 32 in a plate 34. Conventionally the plate 34 includes a plurality of air blast passages 35 which impinge upon the fuel flow at its exit from nozzle 32 to break up and atomize the fuel flow.

The present invention includes a unitary structure 36 disposed within the opening 29 of transverse end plate portion 28 of the dome 22. The structure 36 is configured and arranged to deliver radially inwardly directed, swirling primary airflow, as well as axially directed, swirling primary airflow for support of the combustion process.

More particularly, structure 36 is in the form of a cup-shaped housing including an inner cylindrical wall 38 having an open end 40 opening into the combustion chamber 15, and has its opposite end closed by plate 34 to which it is rigidly secured, to thereby define a cylindrical premixing or mixing chamber 42. Structure 36 further includes a concentric outer cylindrical wall 44 affixed to the inner cylindrical wall 46 through a plurality of vanes 46 described in greater detail below. The inner and outer cylindrical walls 38, 44 define an annular zone therebetween for delivering primary airflow to the combustion process, and the plurality of vanes 46 divide this annular zone into a first set of passages 48 for delivering axially directed primary airflow to the combustion chamber 15, as well as a second set of passages 50 for delivering radial inflow of primary air into mixing chamber 42. A mounting flange 49 affixed to outer cylindrical wall 44 is rigidly secured as by welding to transverse plate 28.

The first set of axial passages 48 as illustrated in the bottom portion of FIG. 1 have opposite axial ends open so as to direct pressurized airflow axially directly into the combustion chamber in circumferentially surrounding in relation to the mixing chamber 42. By contrast, the second set of radial passages 50, one of which is illustrated in the upper portion of FIG. 1, has opposite radial end faces, 52, 54 extending between the inner and outer cylindrical closure walls 38, 44 to prevent axial airflow therethrough. Additionally, aligned with each of these second set of passages is an opening 56 in inner wall 38 and similar slot opening 58 in outer wall 46. Thus, pressurized air will flow radially through slot 58, passage 50 and inner slot 56 to be directed radially inwardly to the mixing chamber 42.

Figure 3:
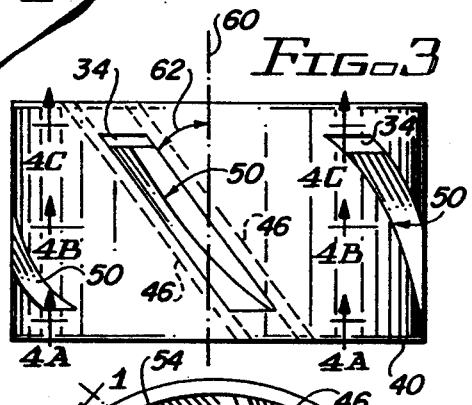
FIG. 3 is a top plan view of the air swirler with portions shown in phantom to reveal further details of construction; an FIGS. 4A, 4B and 4C are enlarged, partial elevational cross-sectional views taken along corresponding lines 4A, 4B and 4C of FIG. 3.
Figure 2:
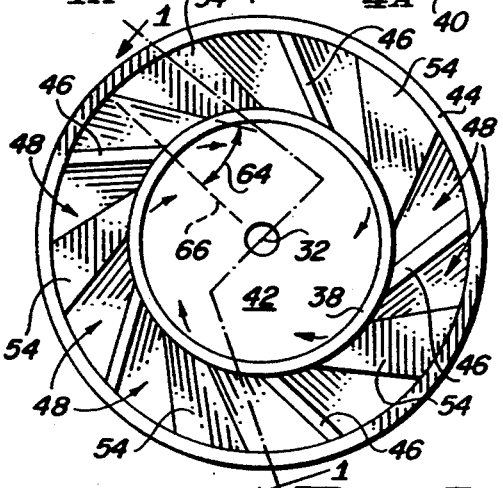
FIG. 2 is a front elevational view of the air swirler of FIG. 1.

As best depicted in FIGS. 2–4, the vanes 46, while being straight, flat, rectangular plates in configuration, are disposed along a plane axially inclined at an aspect angle 62 in relation to the central axis of the mixing chamber 42. Additionally, this same flat, straight rectangular vane 46 is also inclined tangentially at a lean angle 64 relative to a true radial line 66 as depicted in FIG. 2. Preferably the axial aspect angle 62 is between approximately 45° and 60°, while the tangential lean angle 64 is between approximately 45° and 60°.

As best depicted in FIG. 2, the first set of passages 48 and second set of passages 50 are regularly spaced symmetrically about the mixing chamber 42. In the embodiment illustrated, the first set of five passages 50 can be identified by their accompanying end plates 54. Intermediate each of the five radial passages 50 and their associated end plates 54 are a pair of axial passages 48, thus providing a total of ten axial passages 48 in the embodiment illustrated.

Figure 4A:
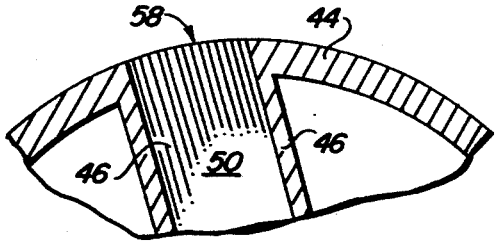
Figure 4B:
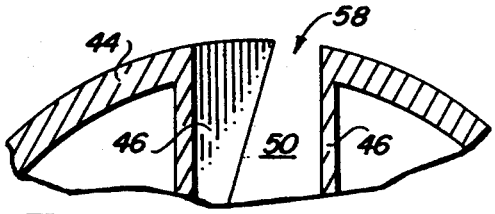
Figure 4C:
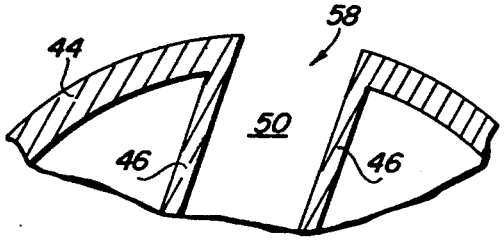

The axial aspect angle 62 of vanes 46 assures that the axial primary airflow passing through the first set of passages 48 is swirling in a clockwise direction as viewed in FIG. 2 upon its entry in to the primary zone of the combustion chamber 15. Because the vanes 46 are straight and flat, the radial passages 50 vary in entrance angle into the mixing chamber 42 along the axial length of the latter as best depicted in FIGS. 4A, 4B and 4C. More particularly, near the closed end of the mixing chamber 42 adjacent the plate 34 the passage 50 is inclined in the direction which would tend to produce counterclockwise rotation as illustrated in FIG. 4C; and at approximately the axial mid point of the mixing chamber 42 the radial passage 54 is directing the airflow on a direct radial line in to the mixing chamber as shown in FIG. 4B. From the mid-point forward to the open end 40 of the mixing chamber 42, the passages 50 become inclined more and more in a direction causing clockwise swirl of airflow entering radially into the mixing chamber 42. At the end of passage 50 most adjacent the open end 40, as illustrated in FIG. 4A, the tangential lean angle becomes that angle 64 illustrated in FIG. 2. The impact of the radial inflow of air most adjacent the open end 40 is predominant and causes the air fuel mixture passing out of open end 40 into the primary zone 15 to swirl in the same direction (i.e. clockwise in FIG. 2) as the direction of swirl of the axial flow exiting the first set of passages 48. Additionally, it will be noted that the plate 34 extends slightly inwardly inside the inner wall 38 so as to close a portion of the passages 50 most remote from opening 40.

In operation, pressurized airflow from the compressor section of the gas turbine engine is introduced inside the case 12 of the combustor, and typically a significant portion of the pressurized air is delivered downstream to pass through the orifices 20 of combustor liner 14. Airflow passing through the orifices 20 near dome 22 may become part of the primary airflow, while that downstream will be the secondary, cooling or dilution airflow for the continuous combustion process. Additionally, a portion of the pressurized airflow may be introduced through dome 22 and/or combustor liner 14 for cooling purposes as conventionally practiced in the art. Airflow passing into the interior of dome shrouds 24 is injected through passages 35 to impinge upon the fuel passing through nozzle 32 to promptly break up and atomize the fuel flow in to small droplets in mixing chamber 42.

Importantly, primary airflow in the present invention passes through axial passages 48 to enter the primary zone of combustion in combustor 15 in an axially swirling flow surrounding the central mixing chamber 42. At the same time, radial inward flow passes through passages 50 to increase the volume of primary airflow introduced into mixing chamber 42. Through the tangentially inclined passages 50, this radial inflow of primary air causes the fuel air mixture leaving the open end 40 of the mixing chamber 42 to also swirl in the same direction as the swirling axial flow from passages 48.

A continuous combustion process occurs in the primary zone of the combustor adjacent and downstream from the open end 40 of the mixing chamber. The swirling imparted to the primary airflow increases residence time thereof so as to stabilize the flame and maintain a continuous combustion process in the primary combustion zone. The swirling nature of both the axial and radial segments of the primary airflow increases the length of time, and therefore the residence time, of the primary airflow in the primary combustion zone to establish flame stabilization, even with the increased volume of primary airflow afforded by both axial and radial passages 48, 50. As noted in copending application Ser. No. 170-91-X21 referred above, increase in primary axial airflow through the dome 22 into the combustor zone 15 promotes a reduction in diameter of the combustor 10. In many applications the outer diameter of combustor 10 may be determinative of the overall diameter of the gas turbine engine.

Testing of the present invention has established that adequate fuel atomization may be maintained while significantly increasing the spray angle of the fuel air mixture exiting open end 40. Testing has also established very adequate mixing of the primary air with the fuel flow.

While the present invention has been illustrated with flat, straight vanes 46, it will be appreciated that the vanes may be curved both radially and axially if so desired. In particular, curvature of the vanes 46 may be utilized to avoid the "reverse" swirl, as illustrated in FIG. 4C, if such is required for a particular application. These and other variations will be apparent to those skilled in the art. For example, while the illustrated embodiment is of an annular combustor the same principles will apply for can-type combustors. Accordingly, the foregoing description should be considered exemplary in nature and not as limiting to the scope and spirit of the invention as set forth in the appended claims.

Having described the invention with sufficient clarity that those skilled in the art may make and use it, what is claimed is:

1. An air swirler for a gas turbine engine fuel nozzle comprising:

a cup-shaped housing having a cylindrical wall defining a mixing chamber therein and opposite closed and open ends, the closed end adapted to deliver fuel flow from the nozzle axially into said mixing chamber;

a concentric outer cylindrical wall surrounding said housing wall;

a plurality of vanes extending radially between said outer wall and housing wall along substantially a major portion of the axial lengths thereof to define air passages between said vanes, said vanes being axially inclined and radially inclined in a tangential direction; and axial end faces extending across and closing opposite axial ends of a first set of said passages, said housing wall and outer wall having openings therethrough into said passages of said first set to deliver radially swirling airflow, substantially without an axial component, into said mixing chamber through said first set of passages, a second set of said passages being open at opposite axial ends to deliver axially swirling airflow downstream of said mixing chamber.

2. A combustor for a gas turbine engine having:

a combustor case;

a combustor liner within the case including cylindrical inner and outer liners connected at one end by a dome;

a fuel nozzle in said dome for delivering fuel flow to said combustor; and an air swirler for delivering primary airflow for the combustion process through the dome, comprising:

a cup-shaped member having a cylindrical wall defining a mixing chamber therein and opposite closed and open ends, the closed end arranged to deliver fuel flow from the nozzle axially into said mixing chamber;

a plurality of vanes extending radially between said outer wall and member wall along substantially a major portion of the axial lengths thereof to define air passages between said vanes, said vanes being axially inclined and radially inclined in a tangential direction; and axial end faces extending across and closing opposite axial ends of a first set of said passages, said member wall and outer wall having openings therethrough into said passages of said first set to deliver radially swirling primary airflow substantially without an axial component, into said mixing chamber through said first set of passages, a second set of said passages being open at opposite axial ends to deliver axially swirling primary airflow downstream of said mixing chamber.

3. A combustor as set forth in claim 2, wherein said combustor is an annular combustor and said combustor liner includes inner and outer concentric, axially extending walls defining said combustor chamber therebetween, said dome interconnecting said combustor liner inner and outer walls.

4. In a combustor for a gas turbine engine having a dome at one end and a fuel nozzle disposed in the dome, air swirl means comprising a unitary cup-shaped structure having concentric inner and outer, cylindrical, axially extending walls defining an annular zone therebetween and a mixing chamber inside said inner wall, said structure having an end face communicating with said fuel nozzle to deliver fuel to said mixing chamber, said structure having a plurality of vanes extending between said inner and outer walls to define passages therebetween, a first set of said passages being open at opposite axial ends of said structure, and another set of said passages opening through both said inner and outer walls to allow radial air inflow into said mixing chamber substantially without an axial component in said radial air flow, said vanes being arranged such that axial airflow through said first set of passages swirls about the axis of said mixing chamber and such that radial air flowing through the portions of said second set of passages remote from said end face swirls radially about said axis of the mixing chamber in the same direction of swirl as said axial airflow in said first set of passages.

5. A combustor as set forth in claim 5, wherein said vanes are of flat, noncurved, rectangular configuration.

6. A combustor as set forth in claim 5, wherein said end face includes axial air blast passages surrounding the fuel nozzle.

7. A combustor as set forth in claim 5, said vanes being axially included at a preselected aspect angle relative to the central axis of said mixing chamber, and being radially inclined at a preselected lean angle at the intersection with said inner wall adjacent said open end of said mixing chamber.

8. A combustor as set forth in claim 7, wherein said aspect angle of said vanes is between approximately 45° and 60°.

9. A combustor as set forth in claim 7, wherein said lean angle of said vanes is between approximately 30° and 60°.

10. A combustor as set forth in claim 9, wherein said lean angle of said vanes is between approximately 45° and 60°.

11. A combustor as set forth in claim 4, wherein said end face extends axially inwardly inside said inner wall.

* * * * *